United States Patent [19]

Sapper

[11] Patent Number: 4,507,077

[45] Date of Patent: Mar. 26, 1985

[54] DRIPLESS CANDLE

[76] Inventor: John M. Sapper, 1720 White Swan Dr., Oshkosh, Wis. 54901

[21] Appl. No.: 342,244

[22] Filed: Jan. 25, 1982

[51] Int. Cl.[3] ..... C11C 5/00

[52] U.S. Cl. ..... 431/228; 44/7.5

[58] Field of Search ..... 431/288, 289, 292; 44/7.5; 126/263; 432/266; 425/803; 264/305; 428/7, 212, 484

[56] References Cited

U.S. PATENT DOCUMENTS

| | | | |
|---|---|---|---|
| 2,807,524 | 9/1957 | Tengh | 44/7.5 |
| 2,841,972 | 7/1958 | Weglin | 431/288 X |
| 3,000,753 | 9/1961 | Rockland | 264/305 X |
| 3,091,952 | 6/1963 | Black | 431/288 |

FOREIGN PATENT DOCUMENTS

| | | | |
|---|---|---|---|
| 170 | of 1854 | United Kingdom | 44/7.5 |

*Primary Examiner*—Samuel Scott

*Assistant Examiner*—Kenichi Okuno

*Attorney, Agent, or Firm*—Andrus, Sceales, Starke & Sawall

[57] ABSTRACT

A non-drip candle is formed of three layers including a thick low melt point core and a thin outer confining high melt wax layer affixed to the core by a special intermediate layer. The intermediate layer formulation includes a paraffin candle wax in combination with a similar quantity of double pressed stearic acid and a high purity tallow acid in the range of 0.5 to 60% and preferably 5 to 10% by weight. A microcrystalline wax of about 5% increases the melt point and produces a smooth finish to the candle, and a resin of about 1% imparts hardness to the layer to permit processing. The candle burns with a shallow rim confining the wax pool about the wick and the multiple layer construction functions to practically instantaneously heal any breach in the rim as the result of deflection of the flame or physical engagement with the rim to establish a true dripless candle.

13 Claims, 3 Drawing Figures

DRIPLESS CANDLE

BACKGROUND OF THE PRESENT INVENTION

This invention relates to a candle having means to minimize the dripping under various burning conditions.

Candles are conventionally formed of paraffin wax of a petroleum derivative. The candles are generally formed by dipping or molding of the wax about an elongated wick. Although candles are made in many shapes and forms, a long, tapered candle is widely used for its grace and beauty. The prior art has long recognized the need of special formulations and methods to reduce or eliminate dripping of the candle as it burns. This is particularly true of the tapered candles, where the dipping along the sides detracts from the beauty of the candle. As the candle burns, the flame may create a cup about the wick. However, disturbance which causes the flame to move so as to approach or engage the cup will tend to disrupt the edge and create a break or opening therewith through which the melted wax may flow. Of course any other disruption of the cup edge, may create a similar opening for escape of the wax. Once such an edge opening is created, the flowing melted wax maintains the opening to create the undesirable dripping of the wax down the side of the candle. Such dripping is undesirable not only because of the reduced available burning and appearance but the hot wax may damage property or person. As noted, various suggestions have been made to reduce or eliminate such dripping.

For example, U.S. Pat. No. 2,726,526 which issued Dec. 15, 1955 and U.S. Pat. No. 3,091,952 which issued June 4, 1963, disclose candles formed of a special composition for minimizing dripping of the candle. U.S. Pat. No. 2,726,526 suggests a mixture of paraffin wax and a substituted phenolic compound without or with a stearic acid such as otherwise used in forming of various types of candles. As more fully discussed in U.S. Pat. No. 3,091,952, others have suggested use of wax formulations of high melting characteristic and using a formulation also including Stearic acid. The burning characteristics are not particularly desirable, and furthermore the materials are expensive. Furthermore, under present day market and governmental regulations the high melt temperature materials are not readily available in sufficient quantity for mass production of such candles.

As also noted in U.S. Pat. No. 3,091,952, others have suggested multiple composition candles, particularly in dipped formed candles, wherein the outer dips are made from a higher melt point formulations. The candle burns with a retention cup of the high melt outer layer which prevents the inner melted wax from dripping down along the candle and marring the beauty of the candle. U.S. Pat. No. 1,863,416, which issued June 14, 1932, discloses a multiple layer candle having an inner cellular core of a relatively low melting point wax and an outer shell of a higher melting point wax. The purpose is to create a deeper cup and prolong the burning life of the candle. Such a unit might also restrict dripping. The deep cup however creates a burn characteristic which is different from the conventional candle with a relatively shallow cup.

Further, in such candles which have heretofore been produced, once the cup is broken, the melted wax which flows through the breaks, maintains the flow path. For example, a very common occurance may involve an air draft across the candle. The air draft deflects the flame laterally toward, and often into engagement with the rim or cup edge. Thus, the opening or closing of doors or windows in the room, or even movement of persons near the candle can readily create air movement sufficient to so deflect the flame. The intensity of the flame is such as to disrupt the rim, thereby initiating flow and drip, which then maintains itself.

Thus, althougl various suggestions of single and multiple composition candles are available, there remains a need for an effective dripless candle in normal usage, and particularly such a candle which can be mass-produced at a commercially acceptable cost.

SUMMARY OF THE PRESENT INVENTION

The present invention is particularly directed to a non-drip candle of a multiple layered construction in which an outer confining layer is provided having a self-healing characteristic so as to maintain the non-drip characteristic even if the melt confining edge is momentarily disrupted. More particularly, the present invention provides an outer cup-defining outer layer structure having a flame retardant which functions to heal a break in the edge and thereby not only create but maintain the hot melted wax confining wall or rim. The formulation of the outer layer structure is such that the confining cup may be relatively shallow so as to maintain a most pleasing burning characteristic. In a particular unique embodiment of the invention, a thin outer high melt point layer is affixed to an inner low melt point core by a special intermediate layer. The intermediate layer formulation in particular in addition to the usual paraffin wax includes at least a small but significant amount of a high carbon chain distribution material, preferably $C_{14-18}$. In particular, the inventor has found that a high purity tallow acid in the intermediate layer produces a self-healing characteristic which essentially prevents any drip during the burn of the candle.

In a preferred embodiment of the invention, the intermediate layer is formed of a formulation of conventional candle wax, the tallow acid and other candle material having enchancement properties. Thus, the formulation preferably includes a double pressed stearic acid which has a crystalline structure and imparts a simulated mechanical interface between the outer high melt point layer and the core. A microcrystalline wax increases the melt point with a long carbon chain for stability and produces a smooth finish to the candle. A resin is preferably added to impart hardness to the layer and the usual candle wax is used to dissolve the other ingredients and further improve the hardness after bonding.

Although the several components all contribute to the quality of the candle and are considered of substantial significance to produce a candle of the high quality required by the inventor, various modifications may be made, if a lesser quality is acceptable.

For optimum results, the ingredients are thoroughly mixed under a controlled temperature and maintained essentially in such condition to provide a bath into which the cool, fully formed inner core is dipped. Thus, although any forming means can be used, the inventor has found that the described dipping provides one particularly commercially practical method of carrying out the invention.

The present invention thus provides an improved dripless candle which maintains the desired characteristic in all normal burning environments and which can be mass produced at a commercially practical and acceptable cost.

DESCRIPTION OF THE DRAWING FIGURES

The drawing furnished herewith illustrates a preferred construction of the present invention in which the above advantages and features are clearly disclosed as well as others which will be readily understood from the following description.

DESCRIPTION OF THE ILLUSTRATED EMBODIMENT

Figure 1:
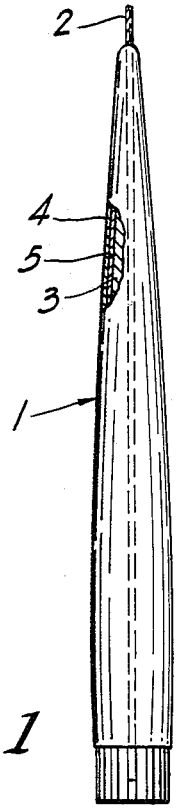
FIG. 1 is a side elevational view of a candle constructed in accordance with the teaching of the present invention, with parts broken away and sectioned to more clearly illustrate the candle.
Figure 2:
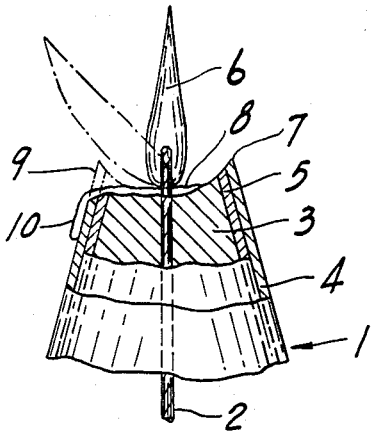
FIG. 2 is an enlarged fragmentary view of the candle of FIG. 1 when the candle is burning.

Referring to the drawings and particularly to FIG. 1, a candle 1 is shown constructed in accordance with the teaching of the present invention. The candle 1 is shown with a well known dinner tapered design having a bottom base for mounting the candle in a decorative support, not shown, such as a candelabra. The candle 1 includes a central wick 2 which extends throughout the length of the candle 1, and particularly an inner core 3 of a relative low melt point candle wax. The thin outermost layer or shell 4 of a high melt point candle wax is affixed to the inner core 3 by a thin intermediate layer 5 of a special formulation to produce a self-healing outer cup defining means, as presently described. Core 3 is substantially thicker than layers 4 and 5 and constitutes substantially the bulk of the candle. The core 3 is a conventional low melt point wax and when wick 2 is lit, the core 3 melts and burns relatively rapidly to maintain a flame 6, as shown in FIG. 2. The outer layer 4 and the intermediate layer 5 are formulated with a greater melt point and in the burning of the candle 1 define a cup with an outer retaining wall or rim 7 which confines the melted core as a wax pool 8 about the burning wick 2. The layers 4 and 5 may be quite thin and are selected to produce a relatively shallow cup to maximize the esthetic appearance of the burning candle 1. With the present invention, the burn cup is formed and maintained with a smooth rim edge which follows down with the burn to maintain an extremely pleasing appearance. Further, the upper edge or rim portion may burn with a distinct encircling halo appearing therein, which further contributes to the high quality appearance of the tapered candle. For example, in one embodiment, the core 3 had a diameter of about 26/32 inches, an outer color layer of about three mils thick and an intermediate layer of about 1.5 mils thick. The layers 4 and 5 should generally be no thicker than 3 mils in a preferred embodiment. The intermediate layer 5, as more fully developed hereinafter, is specially formulated to produce a self-healing and reforming of the wall or rim 7 if such rim 7 is physically disrupted so as to permit escape of the melted core wax 8.

Thus, the wick 2 may be of any suitable material such as the widely used multiple strand cotton. The core 3 may similarly be any well known paraffin having a melting point on the order of 125° F. (degrees fahrenheit). The core wax may, of course, be any suitable blend to promote proper burning at a desired rate, and the various manufacturers, of course, have various formulations. As the formulations of core 3 is only of significance in providing a desired burn rate and flame, no further description is given other than as deemed necessary to more clearly explain the illustrated embodiment.

Similarly, the thin outermost layer 4 may be of any suitable or known high melt point wax, such as typically having a melt point of 135° F. which is commercially available. The layer 4 may, of course, be specially formulated.

Although the core wax and the outer cup-forming wax have melt points in low 100 range, the flame is typically on the order of 700° F. Thus, even a relatively momentary deflection of flame 6, such as shown in phantom in FIG. 2, will rapidly cause the rim 7 to burn away and create a break or opening 9 in the rim 7. Normally, such opening 9 permits the melted wax 8 to escape and drip along the side of candle 1, as at 10. In prior art candles, such drip would increase and move downwardly along the candle.

In the present invention, the special intermediate layer 5 acts with the outer layer 4 to heal and close such opening 9 such as to prevent the continued elongated drop along the candle 1. The intermediate layer 5 thus serves to enhance the outer layer 4 as well as to serve as a support for such layer and establish a compatible bond to the core 3.

More particularly, the intermediate layer 5 includes a wax similar to the core wax and a stearic acid formulation as the main bulk of the material to which a small, but particularly significant amount, of tallow acid has been added. The tallow acid, for optimum results with a true dripless burn, is a high purity tallow acid such as commercially available and known by the trademark Hystrene 7018. The high purity tallow acid particularly functions as a flame retardant which contributes to the formulation of the retaining cup and rim 7, but even more significantly serves to cause the rehealing of rim 7 should it be breached by any external force, whether flame or some other external mechanical force.

A particularly satisfactory formulation which when applied to a 310 wax core has been found to produce a totally dripless candle consisted of the following percentages by weight.

| Percentage | Material Composition | Commercial Source (by trademark) |
|---|---|---|
| 39% | Wax Low Melt | (Lenox Candle 310) |
| 5% | Yellow Microcrystalline Wax | (Shell 400) |
| 50% | Double Pressed Stearic Acid | (Union Camp 1220) |
| 5% | High Purity Tallow Acid | (Hystrene 7018) |
| 1% | Resin | (Piccotex LC) |

The tallow acid as previously described is a particularly significant material. The tallow acid is a long carbon chain material, $C_{14-18}$ which has a flame retardant characteristic to promote the formation of the cup. In addition, the high purity tallow acid serves to cause the rim to heal itself in the event of any breech.

The other materials are used and contribute to the desired formulation as follows.

The wax provides the initial liquid medium for dissolving the several other ingredients as well as producing hardness after bonding of the outer layer thereto. The wax used was a standard core wax used by Lenox Candle of Oshkosh, Wis. The Lenox 310 wax used is a blend of different temperature waxes, such as a blend of a one hundred and twenty-five degree fahrenheit wax, a one hundred and fifty degree fahrenheit wax and a microcrystalline wax which is a long straight chain hydrocarbon, with the percentages by weights being in the range of seventy to eighty, twelve to twenty-two and five to nine which is formulated, and then in addition a stearic acid is added so as to equal about ten to twenty percent by weight of the combined blended wax, which blended wax establishes a melt point of substantially 126° F. Any candle wax with a uniform controlled burn can be used in the core, and therefore no further description thereof is given.

The double pressed stearic acid deposits a crystalline structure between the core 3 and the outer layer 4 which imparts a simulated mechanical interface and coupling of core 3 and outer layer 4. Stearic acid, of course, also contributes in a relatively lesser measure to the flame retardant characteristic of such intermediate layer. The stearic acid should be substantially pure so as to prevent formation of peroxides which can turn the candle wax rancid. Thus, peroxides rapidly form from any available source and promote dripping and thus interfere with the purpose of this invention. This material is thus of substantial significance, but any other crystalline material having a flame retardant characteristic might also be used. For example, various other known acids which might be used include oleic acid, palmitic acid, myristic acid, lauric acid, caprie acid, coconut oil acid, marine oil acid, vegetable oil acid, food grade acid and stearyl alcohols and the like.

The mirocrystalline wax is any suitable material used to impart a smooth finish to the thin outer layer as well as to produce a high melt point. Thus, the core 3 may have a surface with small, subtle imperfections or depressions such as drip marks in a candle core formed by dripping or knife marks in a machine formed candle core. The intermediate layer fills and smooths the same and thereby creates the outer smooth finish. The microcrystalline wax is also a long carbon chain material and provides stability to the intermediate layer material. The microcrystalline wax binds the molecules together so as to prevent cracking and/or blossoming of the outer layer.

The resin is used to impart hardness to the layer upon cooling and any suitable resin may of course be used. Thus, the resin causes the candle surface to freeze or harden practically instantaneously upon removal from the dip so that the candle can be promptly processed in the bath of the outer layer material.

Although the resin and microcrystalline wax contribute to the high quality of the finished dinner candle, such materials are the least critical and may be eliminated without distracting significantly from the non-drip character of the candle.

Figure 3:
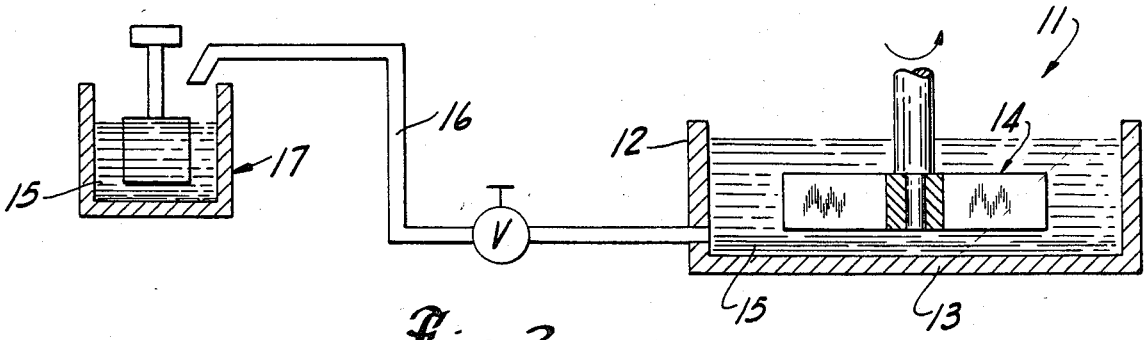
FIG. 3 is a diagrammatic view of mixing unit and a dipping unit for applying the intermediate affixing layer of the candle shown in FIG. 1.

In preparing the formulation, the several ingredients were successively added to a mixer 11 as shown in FIG. 3. The mixer 11 includes an open-topped tank 12 for holding the materials and a heater 13 adapted to raise and hold the formulation therein at a controlled temperature above the melting point of the several ingredients. Thus, a temperature of 170° F. was found to provide satisfactory results. A mixing element 14 is rotatably mounted in the tank 12 and power driven by any suitable means to thoroughly mix the materials 15. The wax forms the principle carrier for dissolving the other ingredients.

The formulation was formed by first melting the wax to produce a liquid bath and the other ingredients were then successively added as listed in the formulation.

The thoroughly mixed hot liquid formulation was maintained at the controlled temperature and then pumped through a suitable line 16 to an insulated dipping tank 17, which included means to both heat and enter the formulation.

The candle core 3 on the wick 2 was fully formed and cooled in a known manner and then dipped in the hot thoroughly mixed intermediate layer formulation.

The coated core was allowed to cool and transferred to the final layer dipping station. The coated core is dipped in the usual manner to apply the thin outer layer 4 to the intermediate layer 5.

Other formulations were similarly prepared and minimized the dripping characteristic.

A second example which has been formulated and provided highly satisfactory results was

| Percentage | Material Composition | Commercial Source |
|---|---|---|
| 34% | Wax | (Lenox Candle 310) |
| 50% | Double Pressed Stearic Acid | (Union Camp 1220) |
| 10% | High Purity Tallow Acid | (Hystrene 7018) |
| 5% | Yellow Microcrystalline Wax | (Shell 400) |
| 1% | Resin | (Piccotex LC) |

As previously noted, the tallow acid or some other similar material is the most significant and in accordance with a significant and unique aspect of the invention is included in substantially the range of 0.5 to 60% by weight and preferably is substantially in the range of 5% to 10% by weight for optimum cost and performance. Thus the tallow acid supplied is to be sufficient to produce a proper retarding action. However, too great a percentage thereof will tend to snuff out the flame as the result of movement into the wax pool 8 and possible clogging of the wick. Further, if the quality standard is reduced, the inventor has found that other similar known flame retardant materials might be used to produce a substantially dripless candle. For example, the inventor has used a blend of forty-eight percent 310 wax, fifty percent double pressed stearic acid and two percent piccatex resin to form the intermediate bonding layer. A second similar formulation was used wherein the resin level was increased to three percent and the 310 wax reduced to forty-seven percent. The triple layered candle using such an intermediate layer operated with essentially no dripping, even under adverse conditions which deflected the flame into engagement with the rim.

Although the intermediate layer components and particularly the tallow acid might be used directly within the outer layer or core, such usage would significantly detract from the quality of the candle. Thus, in the inner core 3 the materials would retard the burning characteristic with a reduced flame height and burn level. As a result, the wax pool would not be consumed at the desired rate and an overflow drip could be created. In the outermost layer the materials would impair the color stability as well as reduce the strength of the bond to the core and reduce the performance as a result of the dilution of materials.

Although described applied to a dipping process for forming of a tapered dinner candle, the multiple layered candle with the unique intermediate layer can within the scope of this invention be otherwise formed, such as by spraying or flow coating.

The present invention thus provides a substantial improvement and advance in the development of a drip-less candle and particularly a tapered dinner candle and the like wherein the esthetic considerations are of a primary significance.

Various modes of carrying out the invention are contemplated as being within the scope of the following claims, particularly pointing out and distinctly claiming the subject matter which is regarded as the invention.

I claim:

1. A non-drip candle comprising an inner core of candle wax having a wick extending through said core, an intermediate bonding layer on said core and substantially coextensive with said core, said intermediate bonding layer being a thin layer substantially less than said core and including a high flame retardant material and a lesser flame retardant material and wax, and an outer high melt layer on said intermediate bonding layer and substantially coextensive with said intermediate bonding layer, said high melt layer being a thin layer on the order of said intermediate layer and having a composition different from said intermediate layer and a melting point significantly greater than said core, said intermediate layer and said outer layer defining a thickness substantially less then said core, and said high flame retardant material essentially isolating a wax pool on the core about the wick from said outer layer and thereby a breach in said outer layer reheals as the candle burns.

2. The non-drip candle of claim 1 wherein said intermediate layer includes a small quantity of a microcrystalline wax.

3. The non-drip candle of claim 1 or 2 wherein said intermediate layer includes a small quantity of a hardening resin.

4. The non-drip candle of claim 1 wherein said high flame retardant material is a high purity tallow acid.

5. A non-drip candle comprising an inner core of candle wax having a low melting point, said candle having a top and a bottom a wick extending through said core, a thin film intermediate layer applied to the outer surface of said core, and a thin film outer layer applied to said intermediate layer and formed of a wax having a significantly higher melt point than said core to form a confining rim at the top of the candle as the result of burning the candle with a wax pool formed about the wick, and said thin film intermediate layer including a wax corresponding to said core, an acid having a crystalline structure and being a flame retardant, a flame retardant acid having a flame retarding characteristic which essentially isolates the wax pool from the outer layer and thereby a breach in the outer layer reheals as the candle burns, a microcrystalline wax to produce a smooth finish in said outer layer and a resin to permit hardening of the intermediate layer.

6. The candle of claim 5 wherein said intermediate layer consists by weight of substantially 39% low melting point candle wax, 50% double pressed stearic acid, 5% yellow microcrystalline wax, 5% high purity tallow acid and 1% resin.

7. The candle of claim 5 wherein said intermediate layer consists by weight substantially of 34% low melting point candle wax, 50% double pressed stearic acid, 5% yellow microcrystalline wax, 10% high purity tallow acid and 1% resin.

8. The candle of claim 5 wherein said intermediate layer consists essentially of similar parts of a double pressed stearic acid and a low melting point candle wax up to 80% by weight and a high purity tallow acid in the range of 0.5 to 60 percent by weight.

9. The candle of claim 8 wherein said high purity tallow acid is in the range of 5 to 10 percent by weight.

10. The candle of claim 5 wherein said core has a thickness at least equal to 26/32 inches and said intermediate layer and said outer layer each have a thickness no greater than three mils.

11. A non-drip candle comprising an inner core of blended wax having a melting point on the order of 125° F., a wick extending through said core, a thin film intermediate layer applied to the outer surface of said core, and a thin film outer layer applied to said intermediate layer and formed of a wax having a significantly higher melt point than said core, said thin film intermediate layer consisting of a candle wax corresponding to said core, a double pressed stearic acid having a crystalline structure and being a flame retardant, a microcrystalline wax to produce a smooth finish in said outer layer, and a resin to permit hardening of the intermediate layer.

12. The candle of claim 11 wherein said intermediate layer includes by weight substantially 48% low melting point candle and microcrystalline wax, 50% double pressed stearic acid and 2% resin.

13. A non-drip candle comprising an inner wax core having a wick extending threrethrough, an outer high melt layer, said high melt layer having a melting point significantly greater than said core and adapted to form a shallow confining cup and a pool of melted wax about the wick during burning, and means to affix the high melt layer about the core with at least one substantially flame retardant material operative to isolate the core and outer high melt layer and self-heal any breach in the wall of the outer high melt layer.

* * * * *

UNITED STATES PATENT AND TRADEMARK OFFICE

CERTIFICATE OF CORRECTION

PATENT NO. : 4,507,077

DATED : March 26, 1985

INVENTOR(S) : John M. Sapper

It is certified that error appears in the above-identified patent and that said Letters Patent is hereby corrected as shown below:

On the title page;

At [56], Cancel "TENGH" and substitute therefor ---TENCH---; Col. 4, line 41, Cancel "formulation" and substitute therefor ---formation---; Claim 5, col. 7, line 44, After "bottom" insert ---,---

Signed and Sealed this

*Fifteenth* Day of *October 1985*

[SEAL]

*Attest:*

*Attesting Officer*

DONALD J. QUIGG

*Commissioner of Patents and Trademarks—Designate*